US012256829B2

(12) United States Patent
Adams

(10) Patent No.: US 12,256,829 B2
(45) Date of Patent: Mar. 25, 2025

(54) APPARATUS TO FACILITATE LIFTING AND CARRYING WIRE HANDLED BUCKETS

(71) Applicant: Michael E Adams, Chicago, IL (US)

(72) Inventor: Michael E Adams, Chicago, IL (US)

( * ) Notice: Subject to any disclaimer, the term of this patent is extended or adjusted under 35 U.S.C. 154(b) by 659 days.

(21) Appl. No.: 17/374,096

(22) Filed: Jul. 13, 2021

(65) Prior Publication Data

US 2022/0007825 A1 Jan. 13, 2022

Related U.S. Application Data

(60) Provisional application No. 63/051,136, filed on Jul. 13, 2020.

(51) Int. Cl.
*A45F 5/10* (2006.01)

(52) U.S. Cl.
CPC ..... *A45F 5/102* (2013.01); *A45F 2200/05* (2013.01)

(58) Field of Classification Search
CPC ..... A45F 5/102; A45F 2200/05
See application file for complete search history.

(56) References Cited

U.S. PATENT DOCUMENTS 5,257,845 A * 11/1993 McConnell ..... A45F 5/102 294/171
8,251,421 B1 * 8/2012 Homan ..... A45F 5/10 294/142
2005/0057056 A1 * 3/2005 Davis ..... B65G 7/12 294/152
2006/0102638 A1 * 5/2006 Summerfield ..... A45F 5/102 220/755
2013/0302496 A1 * 11/2013 Cowan ..... A45F 5/102 426/523
2014/0025036 A1 * 1/2014 Bierman ..... A61B 17/3415 604/506
2017/0073114 A1 * 3/2017 Cartlidge ..... A45F 5/102
2018/0125216 A1 * 5/2018 Walker, Jr. ..... A45F 5/1046

* cited by examiner

*Primary Examiner* — Stephen A Vu

(74) *Attorney, Agent, or Firm* — Patwrite Law; Mark David Torche

(57) ABSTRACT

An apparatus to facilitate lifting and carrying wire handled buckets has a lifting harness and a lifting tray. The lifting harness includes a grip and a connector. The connector connects the grip to the lifting tray. The grip is tubular and comfortable to grasp. The lifting tray is semi-circular in shape and has a notch on one end and is attached to the connector at the other end. In one embodiment, the connector is a cable and is attached with crimp sleeve to the grip and a spherical fitting to the lifting tray. Both the grip and the lifting tray are made of plastic. A method of carrying wire handled buckets includes placing the bucket handle in the lifting tray and holding the lifting tray with one hand and grasping the grip in the other hand to allow both sides of the body to directly engage the bucket's weight.

10 Claims, 8 Drawing Sheets

APPARATUS TO FACILITATE LIFTING AND CARRYING WIRE HANDLED BUCKETS

CROSS REFERENCE TO RELATED APPLICATIONS

This application claims priority and herein incorporates by reference U.S. provisional patent application 63/051,136, filed Jul. 13, 2020.

BACKGROUND OF THE INVENTION

Buckets with wire handles have long been the standard container for a great many consumer, commercial, and industrial goods. Around the world, paint, asphalt sealants, solvents, drywall compounds, landscaping materials and more are shipped, stored and sold in this true commodity item, the most common being five gallon plastic buckets. Empty buckets are even widely used as a tote for various goods at home or on the job. United States production of five gallon buckets alone is now hundreds of millions of units annually.

For all their utility however, five gallon buckets are heavy, trunk-twisting loads that even strong individuals struggle to carry. Inherently cumbersome, they compromise safety, particularly on narrow or slippery surfaces. When just one side of the body directly engages heavy buckets, that arm and shoulder are subjected to unusual stresses. External oblique muscles on the side opposite the bucket are stretched, strain is felt in the lower back and potentially problematic lateral forces bear on the knee nearest the bucket. Finally, small revolving grip sleeves can compress or pinch fingers while bare wire handles can cut into a user's hand.

Accordingly, there is a need for a device that directly involves both the "bucket" and "non-bucket" sides of the body in lifting and carrying buckets. Such a device will automatically promote good posture when carrying these historically lop-sided loads. It will work whether a bucket is on a user's right or left side, does or does not have a grip sleeve on its handle, and will fit a broad range of users. Ideally, it will also be easy to use, lightweight, reusable, collapsible, durable, and inexpensive to produce. The present invention satisfies all these objectives.

SUMMARY OF THE INVENTION

An apparatus to facilitate lifting and carrying wire handled buckets has a lifting harness and a lifting tray. The lifting harness includes a grip and a connector. The connector connects the grip to the lifting tray. The grip is tubular and comfortable to grasp. The lifting tray is semi-circular in shape and has a notch on one end and is attached to the connector at the other end. In one embodiment, the connector is a cable and is attached with crimp sleeve to the grip and a spherical fitting to the lifting tray. Both the grip and the lifting tray are made of plastic. A method of carrying wire handled buckets includes placing the bucket handle in the lifting tray and holding the lifting tray with one hand and grasping the grip in the other hand to allow both sides of the body to directly engage the bucket's weight.

Other features and advantages of the instant invention will become apparent from the following description of the invention which refers to the accompanying drawings.

DETAILED DESCRIPTION OF THE INVENTION

Figure 1:
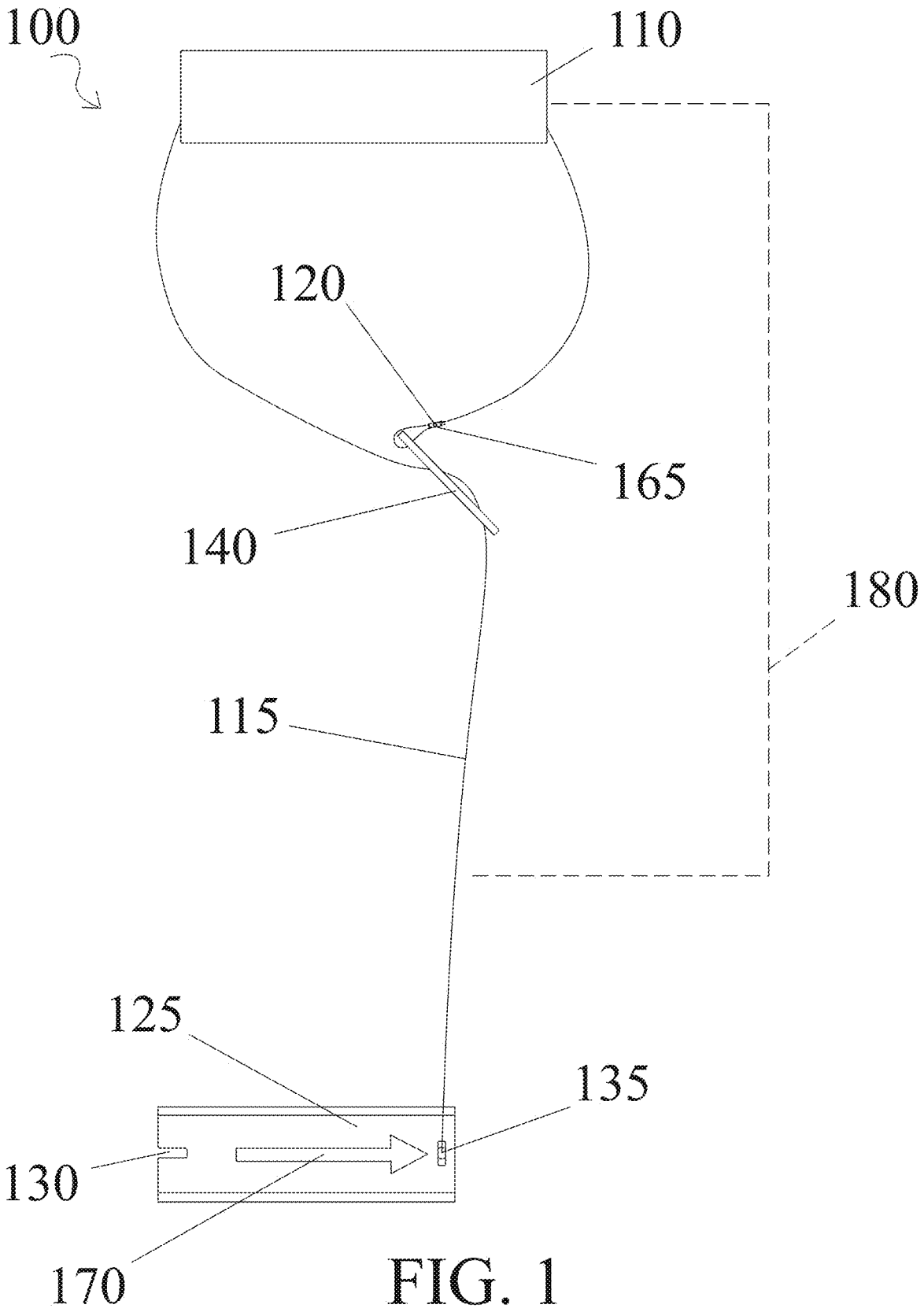
FIG. 1 is a drawing of an apparatus to facilitate lifting and carrying wire handled buckets according to an embodiment of the invention.
Figure 2:
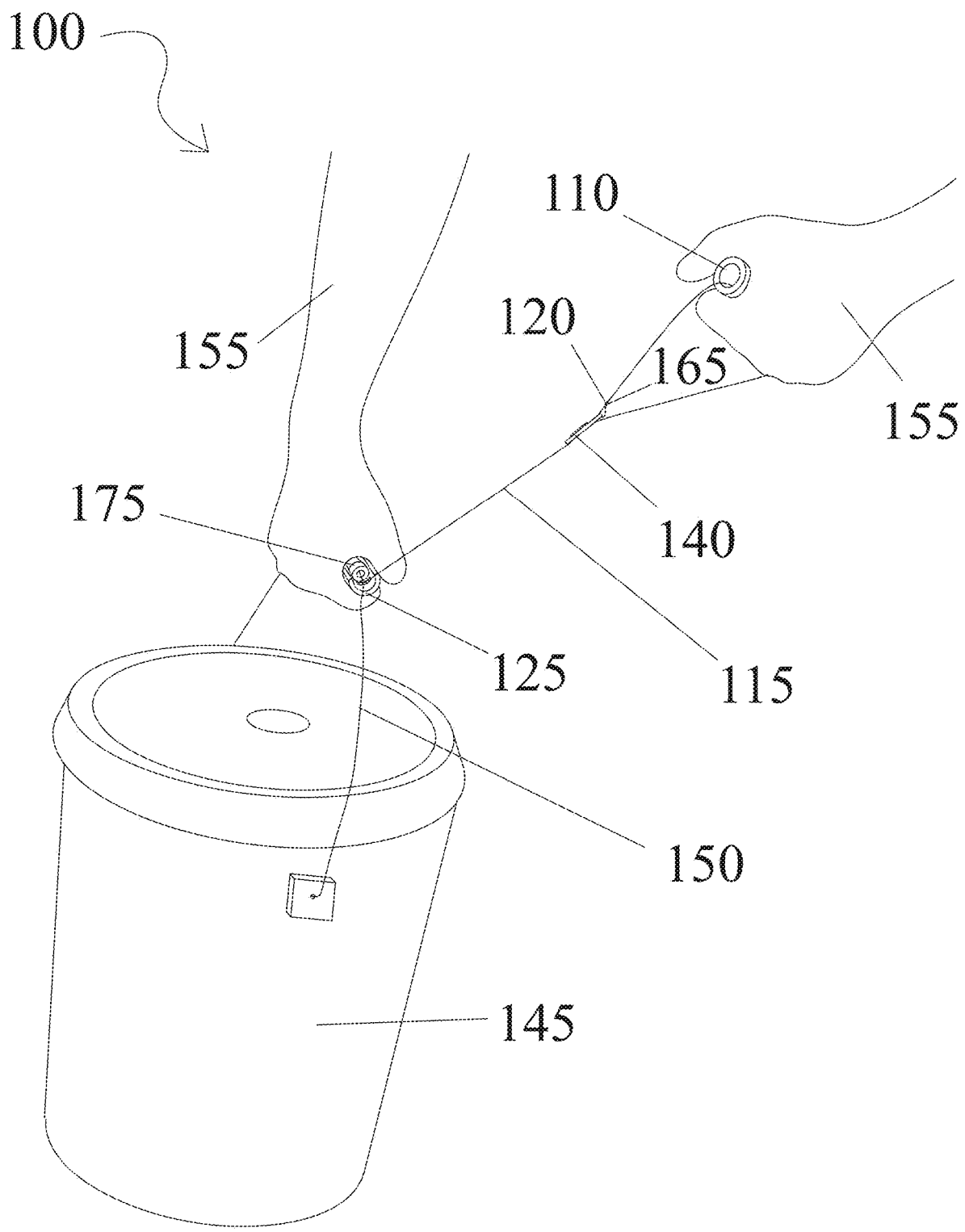
FIG. 2 is a drawing of the apparatus shown in FIG. 1 in use.
Figure 3:
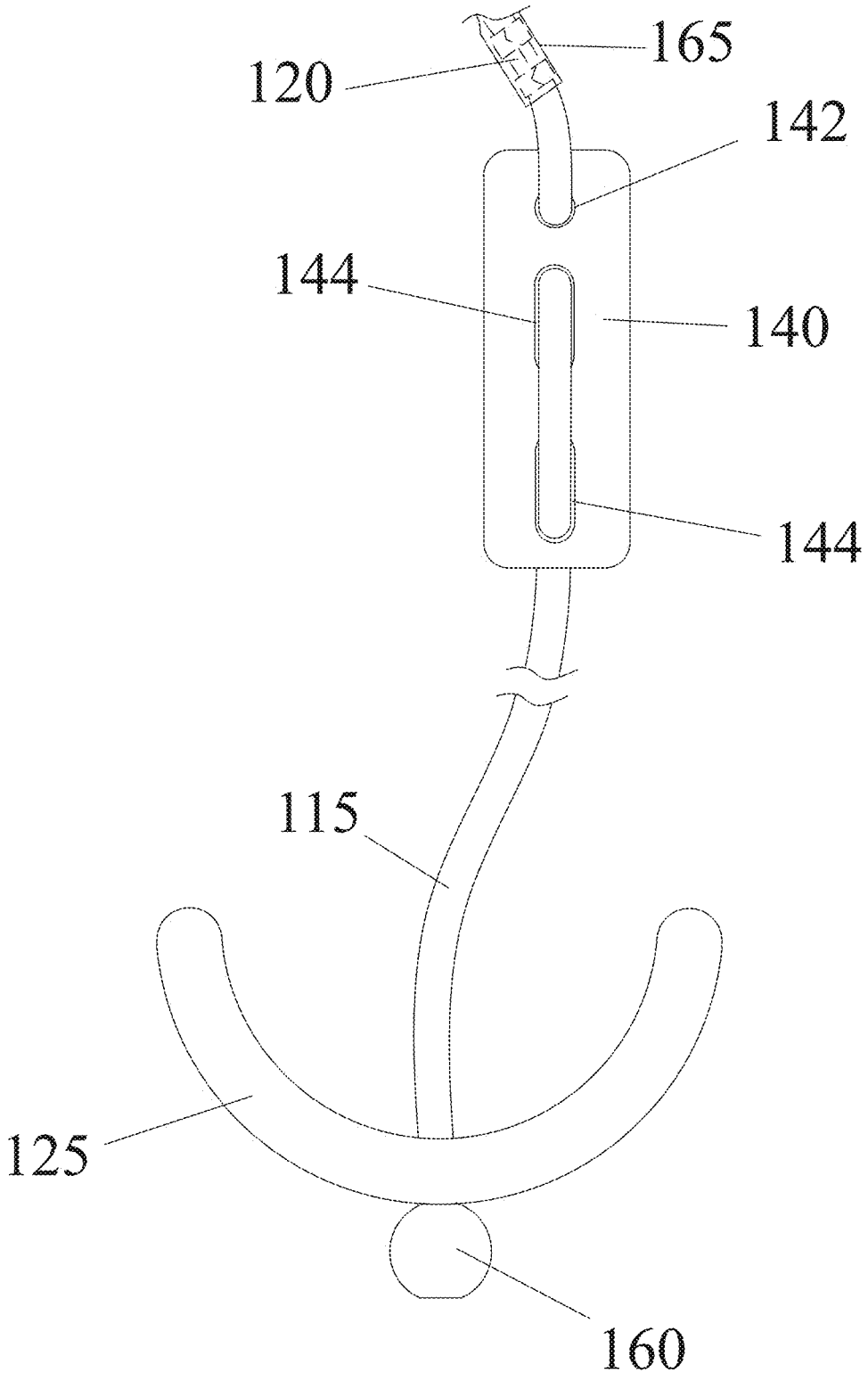
FIG. 3 is a close-up illustration of the lift tray, cable and adjustment bar shown in FIG. 1.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Referring to FIGS. 1-4, an apparatus to facilitate lifting and carrying wire handled buckets 100 is shown having a grip 110 with a cable 115 passed through grip 110 and attached at an upper end to an adjustment bar 140. Adjustment bar 140 has two locking slots 144 through which cable 115 is threaded. An attachment hole 142 is provided for affixing cable 115 with a crimp sleeve 120 that is covered with a molded jacket 165 that protects a user 155 from sharp edges of cable 115 and crimp sleeve 120. Together, grip 110, cable 115 and adjustment bar 140 make up a lift harness 180. At a lower end of cable 115, a lift tray 125 is used to cradle a wire handle 150 and is secured to cable 115 using a ball retainer 160 that is attached to the lower end after passing through a lift tray connection slot 135. Ball retainer 160 is a steel ball affixed to cable 115, but could be made of any suitable material as is known in the art.

Figure 4:
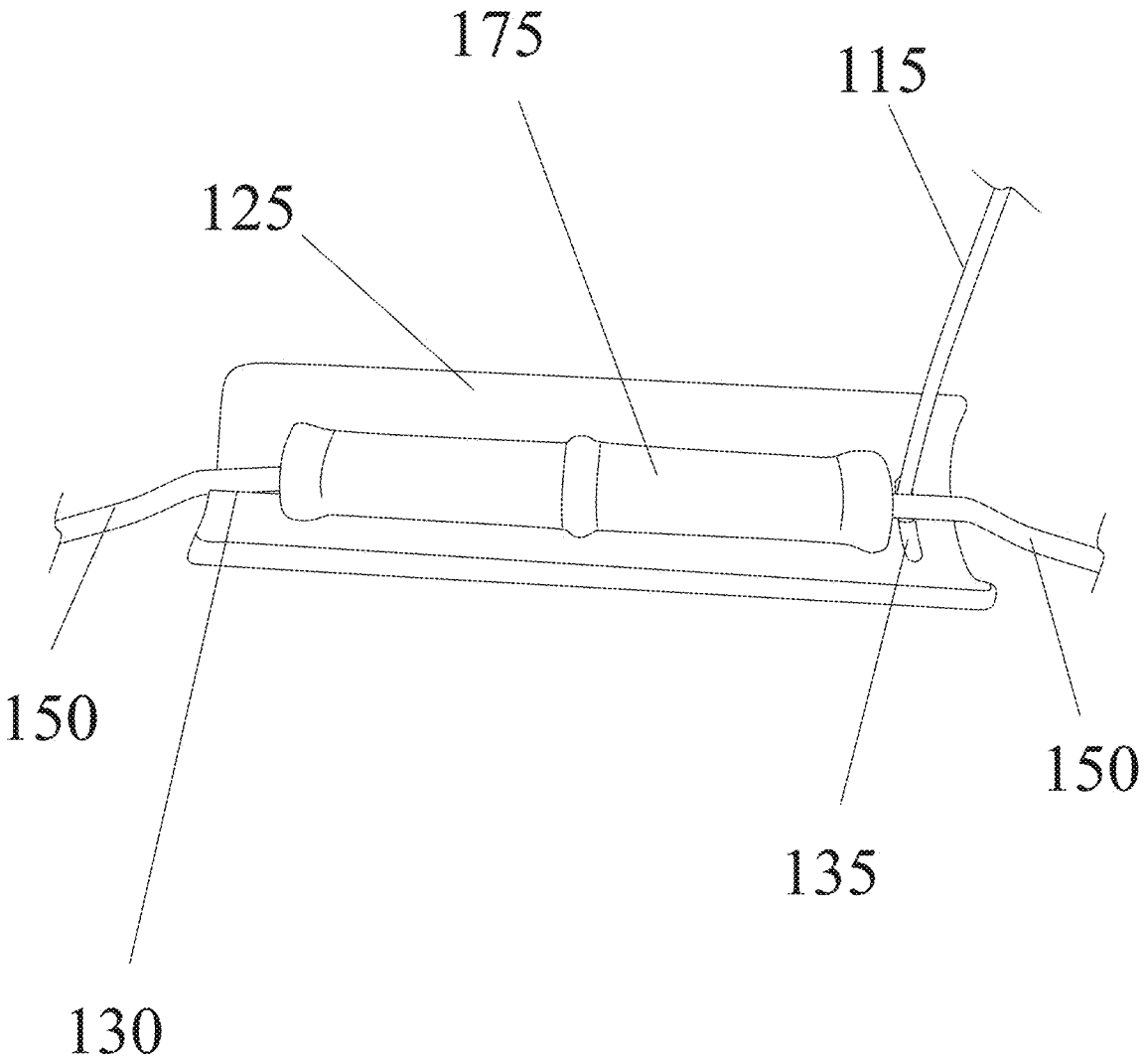
FIG. 4 is a close-up illustration of the lift tray with the bucket handle placed within as shown in FIG. 2.

Many buckets include a grip sleeve 175 that fits over wire handle 150. Lift tray 125 also holds buckets having grip sleeve 175 as shown in FIG. 4. Lift tray connection slot 135 allows cable 115 to be positioned to the inside of wire handle 150 of a bucket 145 whether a bucket is to be carried on a user's right or left side. Lift tray 125 also has a handle notch 130 that is used to stabilize wire handle 150 within lift tray 125, as well as accommodate different length grip areas on the wire handle. Although lift tray 125 is shown with handle notch 130, it is not essential to include this notch.

In operation, user 155 adjusts the length of cable 115 using adjustment bar 140 by moving adjustment bar 140 up or down cable 115 as is well known on self-locking "line tensioners". This allows users to safely and comfortably distribute effort and a bucket's weight across the body regardless of the user's size or shape.

To operate, user 155 places wire handle 150 into lift tray 125 with one hand, while grasping grip 110 with the other hand and then simultaneously pulling up with the bucket side hand and diagonally up with the non-bucket side hand, the user raises the bucket to a comfortable carrying height. A direction arrow 170 is embossed or printed on the inside bottom of lift tray 125 to ensure proper orientation in use to evenly distribute effort and weight across a user's body.

Cable 115 is a plastic-coated steel cable, but to provide a secure connection from the grip to the lifting tray, other connectors could be used, such as, but not limited to chain, synthetic webbing or rope. Both the lift tray and grip are made of a strong plastic, but could also be made of aluminum, steel or any other material of sufficient strength and impact resistance to satisfy the service demands of the device. Additionally, although grip 110 is shown as being tubular, other geometries could be used without departing from the scope of the present invention.

Figure 5:
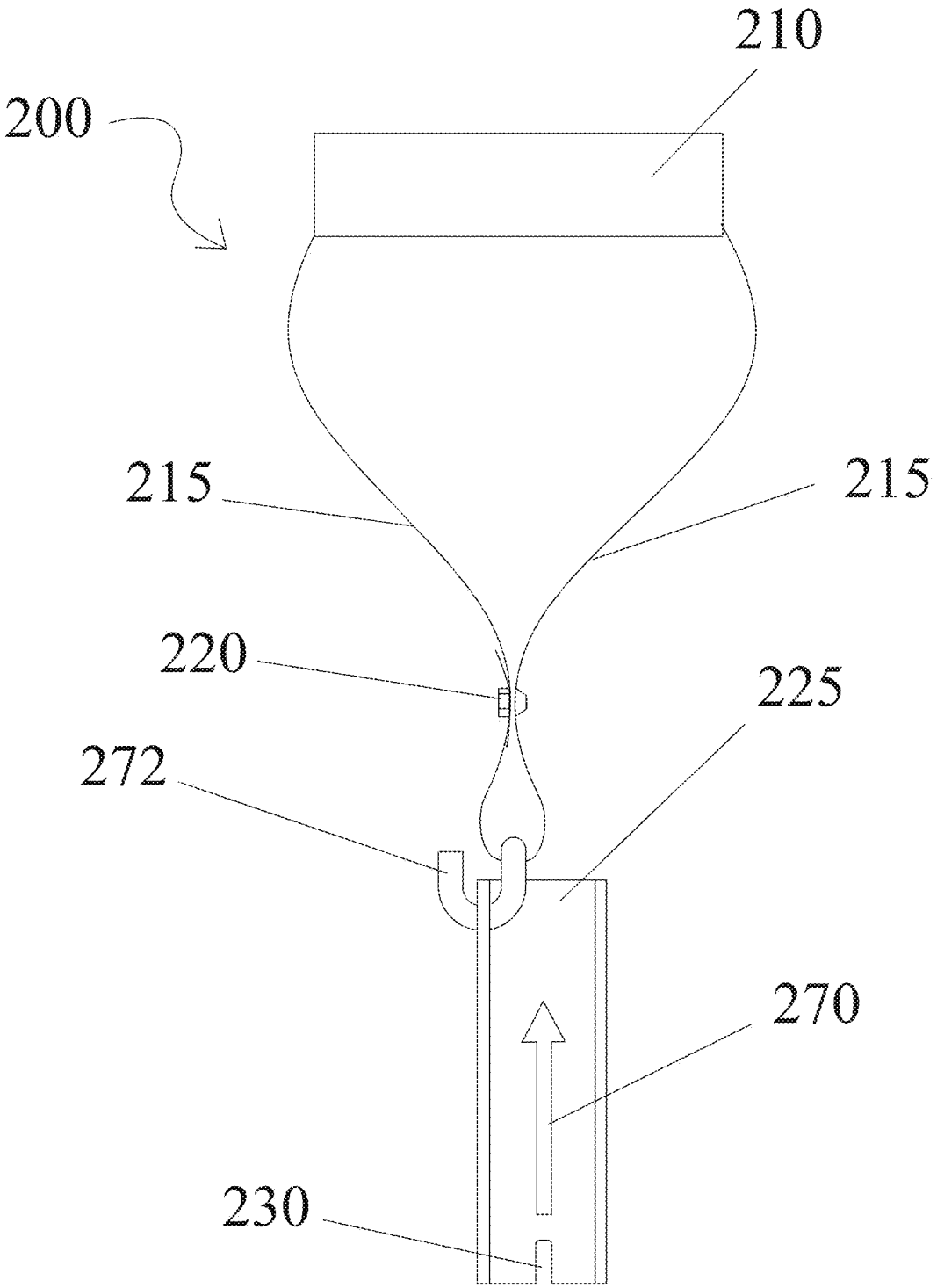
FIG. 5 is a front view of an apparatus to facilitate lifting and carrying wire handled buckets according to an embodiment of the invention.
Figure 6:
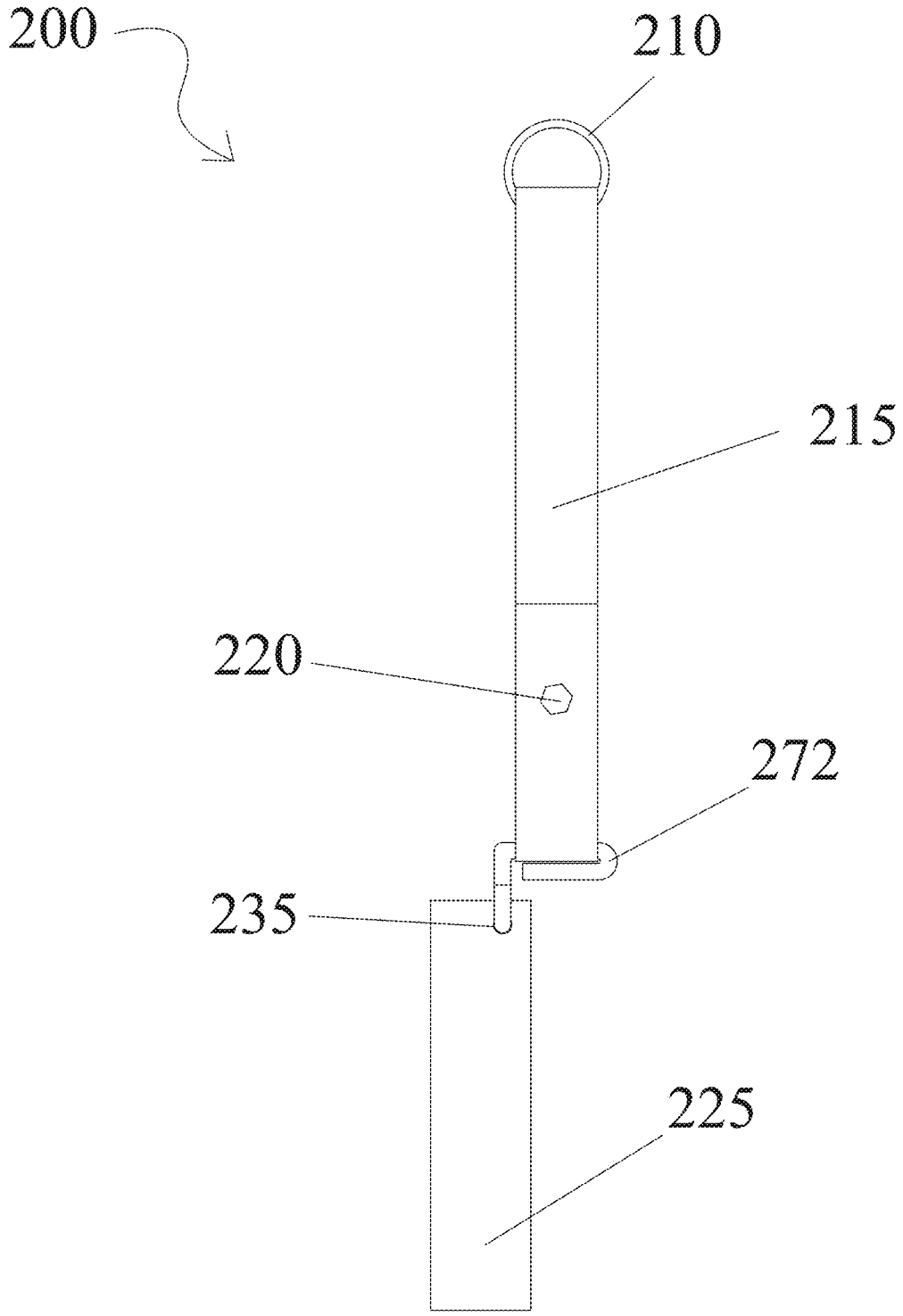
FIG. 6 is a side view of the apparatus to facilitate lifting and carrying wire handled buckets as shown in FIG. 5.

Now referring to FIGS. 5 and 6, an alternative embodiment of an apparatus to facilitate lifting and carrying wire handled buckets 200 is shown having a grip 210 with a strap 215 passing through grip 210 and attached at one end to a hook 272 using a fastener 220 which holds the two ends of strap 215 together. A lift tray 225 has a lift tray connection slot 235 along an edge allows an open end of hook 272 to fit within. Lift tray 225 also has a handle notch 230 that guides wire handle 150 within lift tray 225, as well as accommodate different length grip areas on the wire handle. A direction arrow 270 is provided to aid the user in proper orientation. In this embodiment, no length adjustment means are shown, but it should be understood that an adjustment buckle that works with a strap could be added.

Figure 7:
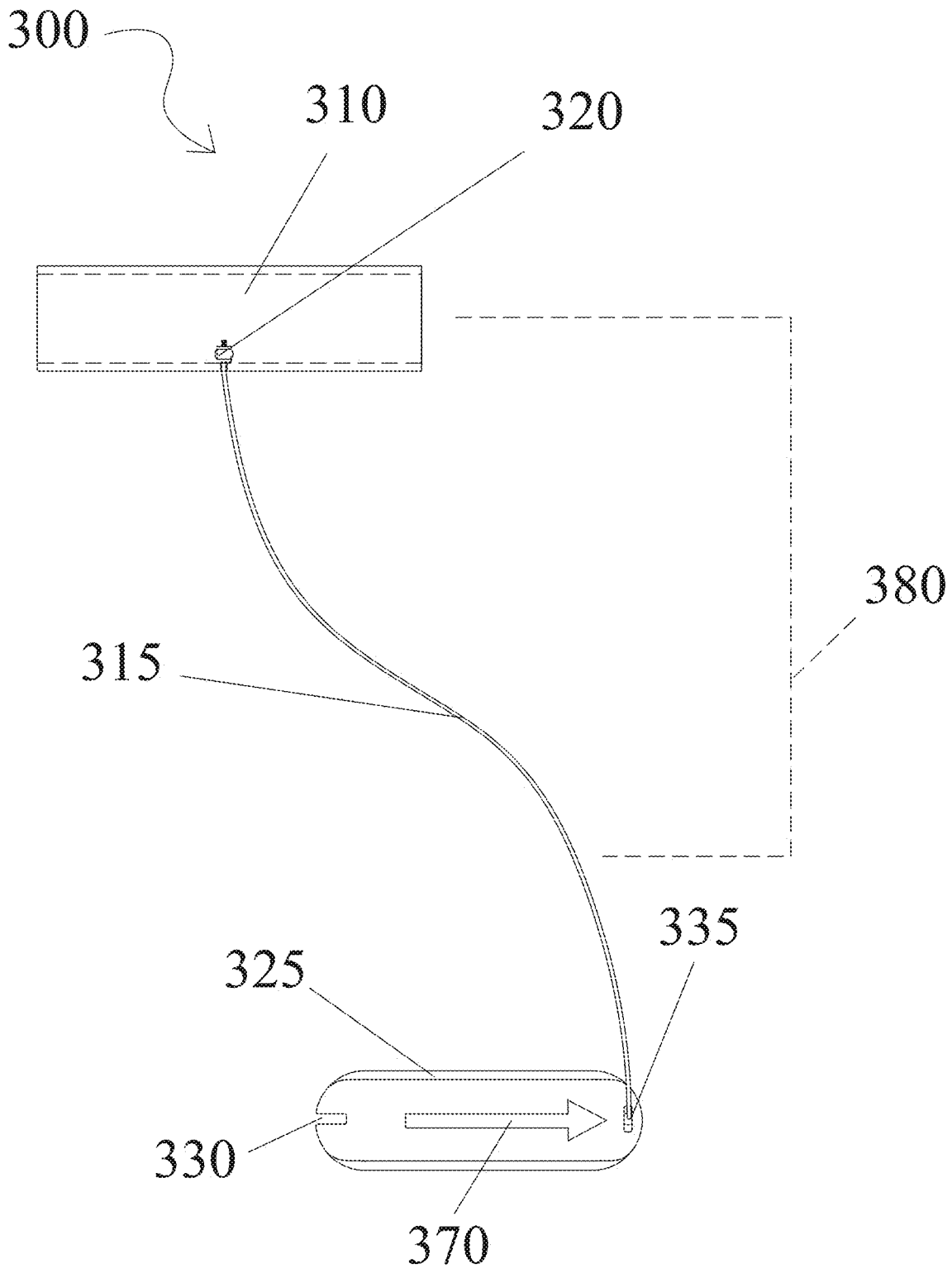
FIG. 7 is a drawing of an apparatus to facilitate lifting and carrying wire handled buckets according to an embodiment of the invention.
Figure 8:
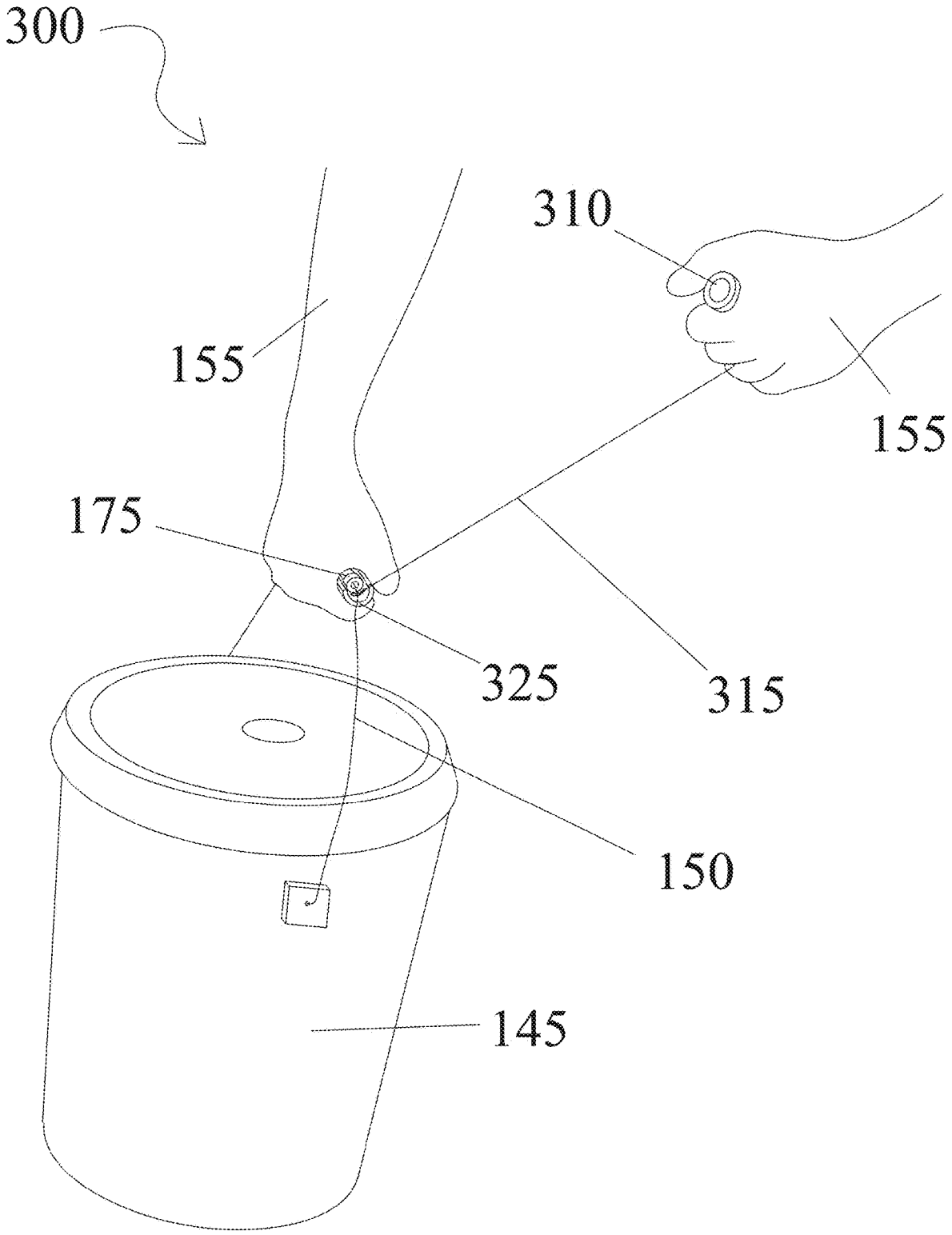
FIG. 8 is a drawing of the apparatus shown in FIG. 7 in use.

Referring now to FIGS. 7 and 8, an apparatus to facilitate lifting and carrying wire handled buckets 300 is shown having a lift harness 380 and a lift tray 325. Lift harness 380 consists of a grip 310 and a cable 315. Cable 315 is held in grip 310 using a crimp sleeve 320. Of course any suitable means may be used to secure cable 315 to grip 310. The other end of cable 315 is secured to a lift tray 325 which holds grip sleeve 175 of a bucket 145. As discussed above with respect to the apparatus shown in FIG. 1 (100), lift tray 325 has a semi-circular shape to cradle grip sleeve 175. Lift tray 325 has a handle notch 330 that fits over wire handle 150. A direction arrow 370 is provided to allow the user to orient lift tray 325 in the proper configuration for lifting. A lift tray connection slot 335 is provided to secure cable 315 to lift tray 325. As discussed above cable 315 fits with lift tray connection slot 335 and a ball retainer 160 (FIG. 3) is applied to secure cable 315 therein.

The present invention is a labor saving device that facilitates lifting and carrying wire handled buckets by better distributing the load's weight across the user's body.

In general, the method of using the apparatus is as follows: the user's hand opposite the bucket grasps the lift harness with an overhand grip and the bucket handle is raised to full height. Next, with the cable to the inside of the wire handle frame, the hand nearest the bucket places the handle within the lift tray and then the user rises to a standing position while simultaneously pulling up with the bucket hand side and diagonally up with the non-bucket side hand to raise the load to the desired carrying height. In this way, the weight of the bucket is evenly borne by the bucket side of the body through the lift tray and the non-bucket side of the body through the attached lift harness. To set the load down, the user opens the bucket side hand and uncouples the device from the bucket.

Surfaces in contact with the user's hand more broadly distribute pressure than standard bucket handles and the cables flexibility allows the device to be collapsed for shipping, carrying or storing for example in a tool box or tool belt. Additionally, the present invention not only facilitates carrying buckets over level ground, it also aids when transporting them up and down stairs, in and out of vehicles and on or off landings, shelves pallets, and the like.

In addition to buckets, the instant invention is also useful in carrying other items that can fit in within the lift tray such as, but not limited to, luggage grips, tool box handles, etc.

Although the instant invention has been described in relation to particular embodiments thereof, many other variations and modifications and other uses will become apparent to those skilled in the art.

What is claimed is:

1. A method of carrying lifting and carrying wire handled buckets comprises:

obtaining an apparatus to facilitate lifting and carrying wire handled buckets wherein said apparatus comprises;

a lifting harness:

said lifting harness comprising;

a grip;

a connector having a first end and a second end;

said first end being securedly fastened to said grip;

a lifting tray;

said lifting tray having an attachment end and a notched end; and said second end being fastened to said attachment end;

placing a bucket handle in said lifting tray wherein a portion of said bucket handle fits in said notched end;

wrapping a user's hand around said lifting tray;

holding said grip with said user's other hand; and lifting and carrying said bucket using both said lifting harness and said lifting tray wherein a load is distributed across said user's body.

2. The apparatus of claim 1 wherein said connector is a cable.

3. The apparatus of claim 2 further comprising a directional arrow disposed on a top surface of said lifting tray pointing towards said attachment end.

4. The apparatus of claim 2 wherein said grip is essentially tubular.

5. The apparatus of claim 4 wherein said lifting tray is semi-circular in shape wherein a handle is removably secured therein.

6. The apparatus of claim 4 wherein said first end is securedly attached to said grip by passing through said grip wherein said first end loops through said grip to secure said first end to said grip.

7. The apparatus of claim 6 further comprising:

an adjustment bar secured to said first end;

said adjustment bar having at least two adjustment holes wherein said second end passes through said at least two adjustment holes and then attached to said attachment end wherein a length of said cable is adjustable.

8. The apparatus of claim 6 further comprising:

a hook attached to said second end;

an attachment hole disposed within a side of said lifting tray on said attachment end of said lifting tray wherein said lifting tray is secured to said second end by said hook inserted in said attachment hole.

9. The apparatus of claim 2 wherein said first end is secured to said grip with a crimp sleeve and said second end is secured to said attachment end with a spherical fitting.

10. The apparatus of claim 1 wherein said grip and said lifting tray are made of plastic.

* * * * *